US010605275B2

(12) United States Patent
Suzuki et al.

(10) Patent No.: US 10,605,275 B2
(45) Date of Patent: Mar. 31, 2020

(54) FLUID PRESSURE CYLINDER

(71) Applicant: SMC CORPORATION, Chiyoda-ku (JP)

(72) Inventors: Yasunaga Suzuki, Kasukabe (JP); Chiaki Fukui, Abiko (JP); Makoto Yaegashi, Tsukubamirai (JP)

(73) Assignee: SMC CORPORATION, Chiyoda-ku (JP)

( * ) Notice: Subject to any disclaimer, the term of this patent is extended or adjusted under 35 U.S.C. 154(b) by 21 days.

(21) Appl. No.: 15/580,133

(22) PCT Filed: Jun. 1, 2016

(86) PCT No.: PCT/JP2016/002637
§ 371 (c)(1),
(2) Date: Dec. 6, 2017

(87) PCT Pub. No.: WO2016/199375
PCT Pub. Date: Dec. 15, 2016

(65) Prior Publication Data

US 2018/0135664 A1 May 17, 2018

(30) Foreign Application Priority Data

Jun. 11, 2015 (JP) ..... 2015-118199

(51) Int. Cl.
*F15B 15/14* (2006.01)
*F15B 15/22* (2006.01)

(52) U.S. Cl.
CPC ..... *F15B 15/1461* (2013.01); *F15B 15/1438* (2013.01); *F15B 15/1447* (2013.01); *F15B 15/22* (2013.01)

(58) Field of Classification Search
CPC ..... F15B 15/1433; F15B 15/1438; F15B 15/1442; F15B 15/1423; F15B 15/1471; F15B 15/184; F15B 15/18; F16J 10/02
See application file for complete search history.

(56) References Cited

U.S. PATENT DOCUMENTS 2,616,687 A * 11/1952 Butterfield ..... F16F 9/063 267/64.17
3,136,225 A 6/1964 Rader
(Continued)

FOREIGN PATENT DOCUMENTS

CH 643 638 A5 6/1984
CN 1272167 A 11/2000
(Continued)

OTHER PUBLICATIONS

Combined Chinese Office Action and Search Report dated Jan. 11, 2019 in Chinese Patent Application No. 201680033247.0 (with English translation), 12 pages.
(Continued)

*Primary Examiner* — F Daniel Lopez
*Assistant Examiner* — Michael Quandt
(74) *Attorney, Agent, or Firm* — Oblon, McClelland, Maier & Neustadt, L.L.P.

(57) ABSTRACT

In an interior of a cylinder tube of a fluid pressure cylinder, a piston unit is displaced along an axial direction under the supply of a pressure fluid, and the piston unit is connected to one end of a piston rod. Further, a rod cover is disposed on another end of the cylinder tube, and in the center thereof, a cylindrical holder is provided that displaceably supports the piston rod. The holder is fixed integrally by a plurality of first rivets, in a state in which a flange member, which is expanded radially outward, abuts against an inner wall surface of the rod cover.

8 Claims, 8 Drawing Sheets

(56) References Cited

U.S. PATENT DOCUMENTS

| | | | | |
|---|---|---|---|---|
| 3,175,474 | A | 3/1965 | Eickmann | |
| 3,655,204 | A * | 4/1972 | Sievenpiper | F15B 15/1433 277/346 |
| 3,835,753 | A | 9/1974 | Bunyard | |
| 4,086,456 | A | 4/1978 | Bone | |
| 4,312,264 | A | 1/1982 | Nunnemacher et al. | |
| 4,370,918 | A | 2/1983 | Pringle | |
| 4,896,584 | A | 1/1990 | Stoll et al. | |
| 5,193,433 | A | 3/1993 | Reimer | |
| 5,241,896 | A | 9/1993 | Braun et al. | |
| 5,400,696 | A | 3/1995 | Weber | |
| 5,618,142 | A * | 4/1997 | Sonden | F16B 19/083 29/525.06 |
| 5,651,631 | A | 7/1997 | Carmien | |
| 6,038,959 | A | 3/2000 | Sawada | |
| 6,186,484 | B1 | 2/2001 | Noda et al. | |
| 6,199,847 | B1 | 3/2001 | Fukui | |
| 6,386,088 | B1 | 5/2002 | Yoshimoto et al. | |
| 9,038,527 | B2 | 5/2015 | Orihara et al. | |
| 9,410,624 | B2 | 8/2016 | George | |
| 2004/0107557 | A1 | 6/2004 | Morris et al. | |
| 2007/0048156 | A1 | 3/2007 | Chung et al. | |
| 2008/0173169 | A1 | 7/2008 | Ikari | |
| 2013/0032027 | A1 | 2/2013 | Orihara et al. | |
| 2014/0069271 | A1 | 3/2014 | Ishibashi et al. | |
| 2014/0076157 | A1 | 3/2014 | Fukui | |
| 2015/0267723 | A1* | 9/2015 | Kim | F16F 9/366 92/61 |
| 2016/0084220 | A1 | 3/2016 | Moeller et al. | |
| 2017/0191507 | A1 | 7/2017 | Marinoni et al. | |

FOREIGN PATENT DOCUMENTS

| | | | |
|---|---|---|---|
| CN | 201170227 | Y | 12/2008 |
| CN | 201599273 | U | 10/2010 |
| CN | 103562567 | A | 2/2014 |
| DE | 81 24 287 | U1 | 12/1981 |
| DE | 199 25 600 | A1 | 12/2000 |
| DE | 101 41 560 | A1 | 3/2003 |
| DE | 10 2009 020 286 | A1 | 11/2010 |
| EP | 0 190 528 | A1 | 8/1986 |
| EP | 1 001 174 | A1 | 5/2000 |
| FR | 2 575 527 | A1 | 7/1986 |
| JP | 48-14117 | Y1 | 4/1973 |
| JP | 50-152085 | | 12/1975 |
| JP | 52-27972 | | 3/1977 |
| JP | 52-125985 | A | 10/1977 |
| JP | 56-5605 | Y1 | 2/1981 |
| JP | 56-115010 | U | 9/1981 |
| JP | 59-1493 | U | 1/1984 |
| JP | 62-107103 | U | 7/1987 |
| JP | 63-111303 | A | 5/1988 |
| JP | 5-6204 | U | 1/1993 |
| JP | 5-59212 | U | 8/1993 |
| JP | 11-37112 | A | 2/1999 |
| JP | 11-62910 | A | 3/1999 |
| JP | 11-132204 | A | 5/1999 |
| JP | 11-153104 | A | 6/1999 |
| JP | 2000-074007 | A | 3/2000 |
| JP | 2005-54977 | A | 3/2005 |
| JP | 2007-16916 | A | 1/2007 |
| JP | 2008-133920 | A | 6/2008 |
| JP | 2012-57770 | A | 3/2012 |
| JP | 2014-219038 | A | 11/2014 |
| KR | 10-2014-0034198 | A | 3/2014 |
| KR | 10-2014-0074845 | A | 6/2014 |
| TW | M495452 | U | 2/2015 |
| WO | WO 2012/161159 | A1 | 11/2012 |

OTHER PUBLICATIONS

Combined Chinese Office Action and Search Report dated Dec. 26, 2018 in Chinese Patent Application No. 201680033635.9 (with English translation), 12 pages.

Combined Chinese Office Action and Search Report dated Dec. 27, 2018 in Chinese Patent Application No. 201680033652.2 (with English translation), 16 pages.

Combined Chinese Office Action and Search Report dated Jan. 16, 2019 in Chinese Patent Application No. 201680033671.5 (with English translation), 17 pages.

U.S. Appl. No. 15/580,098, filed Dec. 6, 2017, Yasunaga Suzuki, et al.

U.S. Appl. No. 15/580,109, filed Dec. 6, 2017, Yasunaga Suzuki, et al.

U.S. Appl. No. 15/580,106, filed Dec. 6, 2017, Yasunaga Suzuki, et al.

U.S. Appl. No. 15/580,125, filed Dec. 6, 2017, Yasunaga Suzuki, et al.

U.S. Appl. No. 15/580,124, filed Dec. 6, 2017, Yasunaga Suzuki, et al.

Office Action dated Jan. 9, 2018 in Japanese Patent Application No. 2015-118174 (with English language translation).

Office Action dated Jan. 9, 2018 in Japanese Patent Application No. 2015-118182 (with English language translation).

Office Action dated Jan. 9, 2018 in Japanese Patent Application No. 2015-118190 (with English language translation).

International Search Report and Written Opinion dated Oct. 6, 2017 in PCT/JP2016/002637 filed Jun. 1, 2016.

Taiwanese Office Action dated Apr. 27, 2017 in TW Patent Application No. 105118140 (with Search Report and English Translation).

Japanese Office Action dated Aug. 7, 2018 in Japanese Patent Application No. 2015-115190 (with English translation), 6 pages.

Japanese Office Action dated Aug. 7, 2018 in Japanese Patent Application No. 2015-118174 (with English translation), 9 pages.

Office Action dated Jun. 24, 2019, in co-pending U.S. Appl. No. 15/580,125, 13 pages.

Office Action dated Mar. 18, 2019 in Korean Patent Application No. 10-2018-7000911, 8 pages (with unedited computer generated English translation).

Office Action dated Mar. 18, 2019 in Korean Patent Application No. 10-2018-7000913, 7 pages (with unedited computer generated English translation).

Office Action dated Mar. 18, 2019 in Korean Patent Application No. 10-2018-7000915, 7 pages (with unedited computer generated English translation).

Office Action dated May 14, 2019 in co-pending U.S. Appl. No. 15/580,109, 10 pages.

Office Action dated Jun. 3, 2019 in co-pending U.S. Appl. No. 15/580,106, 11 pages.

Office Action dated Jun. 10, 2019 in co-pending U.S. Appl. No. 15/580,124, 12 pages.

Office Action dated Jun. 24, 2019, in co-pending U.S. Appl. No. 15/580,125, 12 pages.

U.S. Office Action dated Nov. 4, 2019 in U.S. Appl. No. 15/580,125.

Korean Office Action dated Aug. 5, 2019 in Korean Patent Application No. 10-2018-7000911 (with unedited computer generated English translation), citing document AO and AP therein, 9 pages.

Combined Chinese Office Action and Search Report dated Aug. 14, 2019 in Chinese Patent Application No. 201680033045.6 (with English translation), citing documents AA and AQ therein, 17 pages.

Office Action dated Aug. 8, 2019 in co-pending U.S. Appl. No. 15/580,098, citing documents AB and AC therein, 14 pages.

* cited by examiner 16
16a
16b
20
48
56
58
60
70
72
126
130
132
134
136
138
140
142
144
150
152
154
160
162
164
166
A
B

FLUID PRESSURE CYLINDER

TECHNICAL FIELD

The present invention relates to a fluid pressure cylinder that displaces a piston in an axial direction under the supply of a pressure fluid.

BACKGROUND ART

Conventionally, as a transport means for a workpiece or the like, for example, a fluid pressure cylinder having a piston that is displaced under the supply of a pressure fluid has been used. The present applicant has proposed a fluid pressure cylinder, as disclosed in Japanese Laid-Open Patent Publication No. 2008-133920, which is closed on both ends by a head cover and a rod cover, and in which the head cover and the rod cover are tightly fastened together with the cylinder tube by four connecting rods.

With this type of fluid pressure cylinder, a piston and a piston rod are disposed for displacement in the interior of the cylinder tube, and by supplying a pressure fluid into cylinder chambers that are formed between the piston and the cylinder tube, the piston is displaced along the axial directions.

SUMMARY OF INVENTION

A general object of the present invention is to provide a fluid pressure cylinder, in which a dimension of the fluid pressure cylinder along an axial direction thereof can be made smaller in size.

The present invention is characterized by a fluid pressure cylinder comprising a cylinder tube including a cylinder chamber defined in interior thereof, a cover member attached to an end of the cylinder tube, a piston disposed displaceably along the cylinder chamber, and a piston rod connected to the piston. A rod holder, which supports the piston rod displaceably along an axial direction, is disposed in the cover member, and the rod holder is fixed by rivets with respect to the cover member.

According to the present invention, in the fluid pressure cylinder, the rod holder, which supports the piston rod displaceably along an axial direction, is provided in the cover member attached to the end of the cylinder tube. The rod holder is fixed to the cover member by rivets.

Consequently, compared to a conventional fluid pressure cylinder in which the cover member is formed with a predetermined thickness, and a rod hole is provided in the interior thereof which is capable of supporting the piston rod, a thickness in the axial direction of the cover member can be formed thinly, and along therewith, the total length of the fluid pressure cylinder can be reduced in size.

Further, since the head portions of the rivets are thinner than the head portions of general screws or the like, compared to the case of fixing the rod holder to the cover member using screws or the like, it is possible to reduce the amount by which the head portions of the rivets project out toward the side of the piston. Therefore, in a fluid pressure cylinder in which a piston having the same stroke amount is disposed, since the cover member can be arranged closely in proximity to the side of the piston by the difference in the thickness of the head portions, the total length of the fluid pressure cylinder can further be reduced.

Furthermore, compared to the case of fixing the rod holder to the cover member by screws or the like, by fixing the same using rivets, fixing of the rod holder can be performed more easily, together with enabling a reduction in the number of assembly steps.

The above and other objects, features and advantages of the present invention will become more apparent from the following description when taken in conjunction with the accompanying drawings, in which a preferred embodiment of the present invention is shown by way of illustrative example.

DESCRIPTION OF EMBODIMENTS

Figure 1:
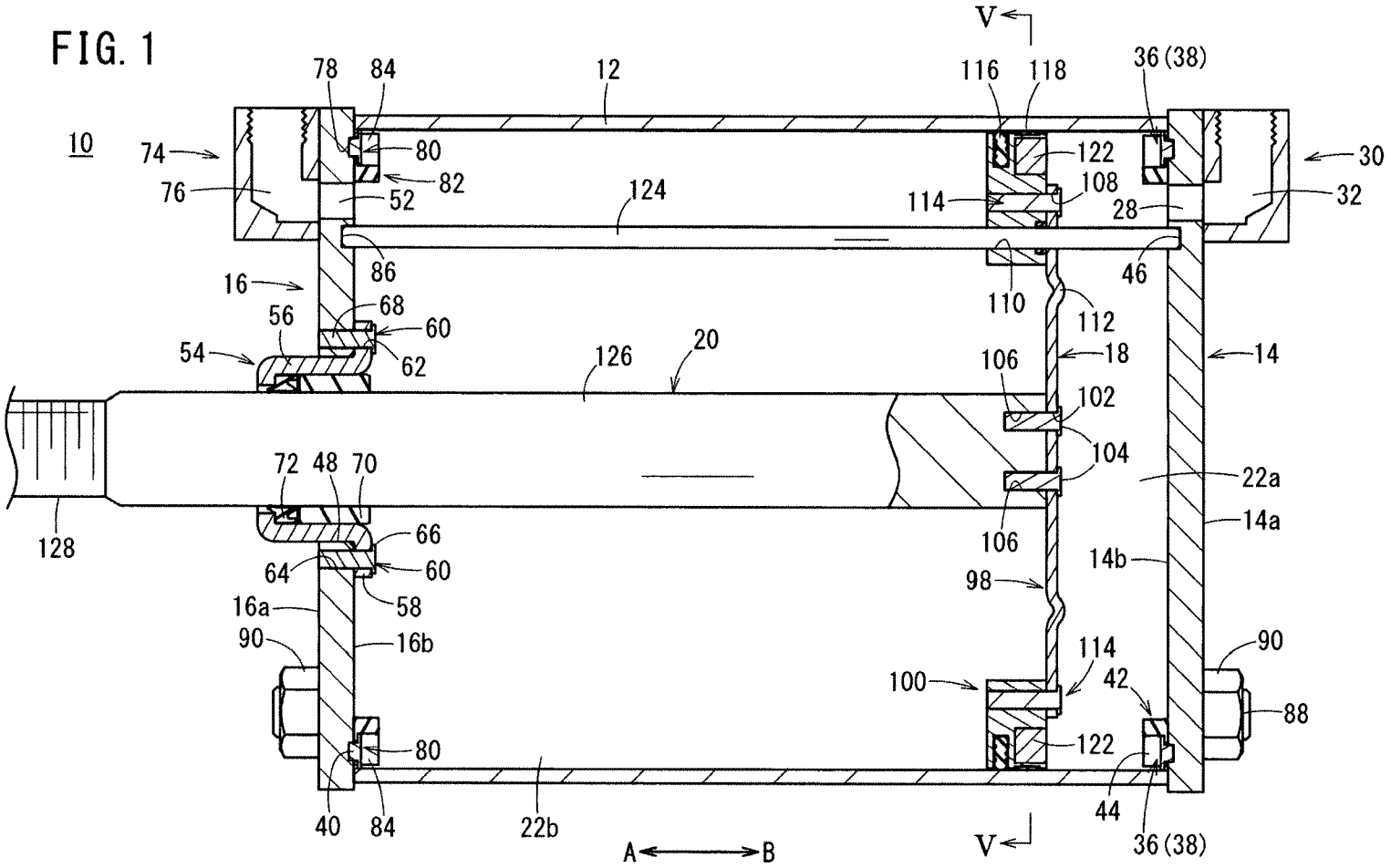
FIG. 1 is an overall cross-sectional view of a fluid pressure cylinder according to an embodiment of the present invention.

As shown in FIG. 1, a fluid pressure cylinder 10 includes a tubular shaped cylinder tube 12, a head cover 14 that is mounted on one end of the cylinder tube 12, a rod cover (cover member) 16 that is mounted on another end of the cylinder tube 12, a piston unit (piston) 18 that is disposed for displacement in the interior of the cylinder tube 12, and a piston rod 20 that is connected to the piston unit 18.

The cylinder tube 12, for example, is constituted from a cylindrical body that is formed from a metal material, and extends with a constant cross-sectional area along the axial direction (the directions of arrows A and B), and in the interior thereof, cylinder chambers 22*a*, 22*b* are formed in which the piston unit 18 is accommodated. Further, on both ends of the cylinder tube 12, ring shaped seal members (not shown) are installed respectively through annular grooves.

As shown in FIGS. 1 through 3A and 4A, the head cover 14, for example, is a plate body that is formed with a substantially rectangular shape in cross section from a metal material, which is provided to cover one end of the cylinder tube 12. At this time, by the seal member (not shown), which is disposed on the end of the cylinder tube 12, abutting against the head cover 14, a pressure fluid is prevented from leaking out from the cylinder chamber 22*a* through a gap between the cylinder tube 12 and the head cover 14.

Figure 4A:
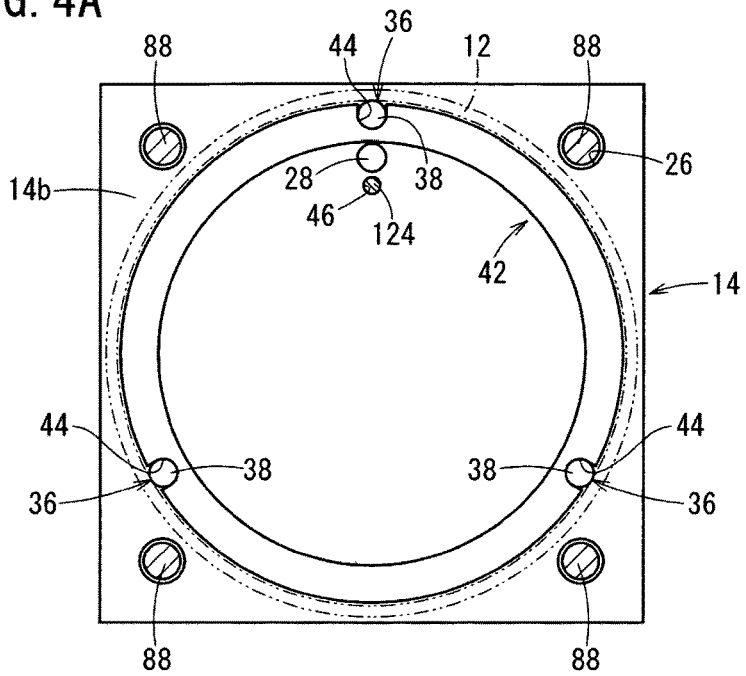
FIG. 4A is a front view shown partially in cross section of the head cover of FIG. 3A as seen from a side of the cylinder tube.

Further, as shown in FIG. 4A, in the vicinity of the four corners of the head cover 14, four first holes 26 are formed, respectively, through which later-described connecting rods 88 are inserted. A first communication hole 28 is formed at a position on a central side of the head cover 14 with respect to the first holes 26. The first holes 26 and the first communication hole 28 penetrate respectively in a thickness direction (the directions of arrows A and B) of the head cover 14 shown in FIGS. 1 and 2.

A first port member 30 from which the pressure fluid is supplied and discharged is provided on an outer wall surface 14*a* of the head cover 14, to which a pressure fluid supply source is connected through a non-illustrated pipe. The first port member 30, for example, is constituted from a block body, which is formed from a metal material, and is fixed by welding or the like.

Further, in the interior of the first port member 30, a port passage 32, which is formed with an L-shape in cross-section, is formed, and an opening thereof is fixed with respect to the outer wall surface 14*a* of the head cover 14 in a state of being opened in a direction perpendicular to the axial direction of the cylinder tube 12.

In addition, by the port passage 32 of the first port member 30 communicating with the first communication hole 28 of the head cover 14, the first port member 30 and the interior of the cylinder tube 12 are placed in communication.

Instead of providing the first port member 30, for example, a pipe connection fitting may be connected directly with respect to the first communication hole 28.

Figure 2:
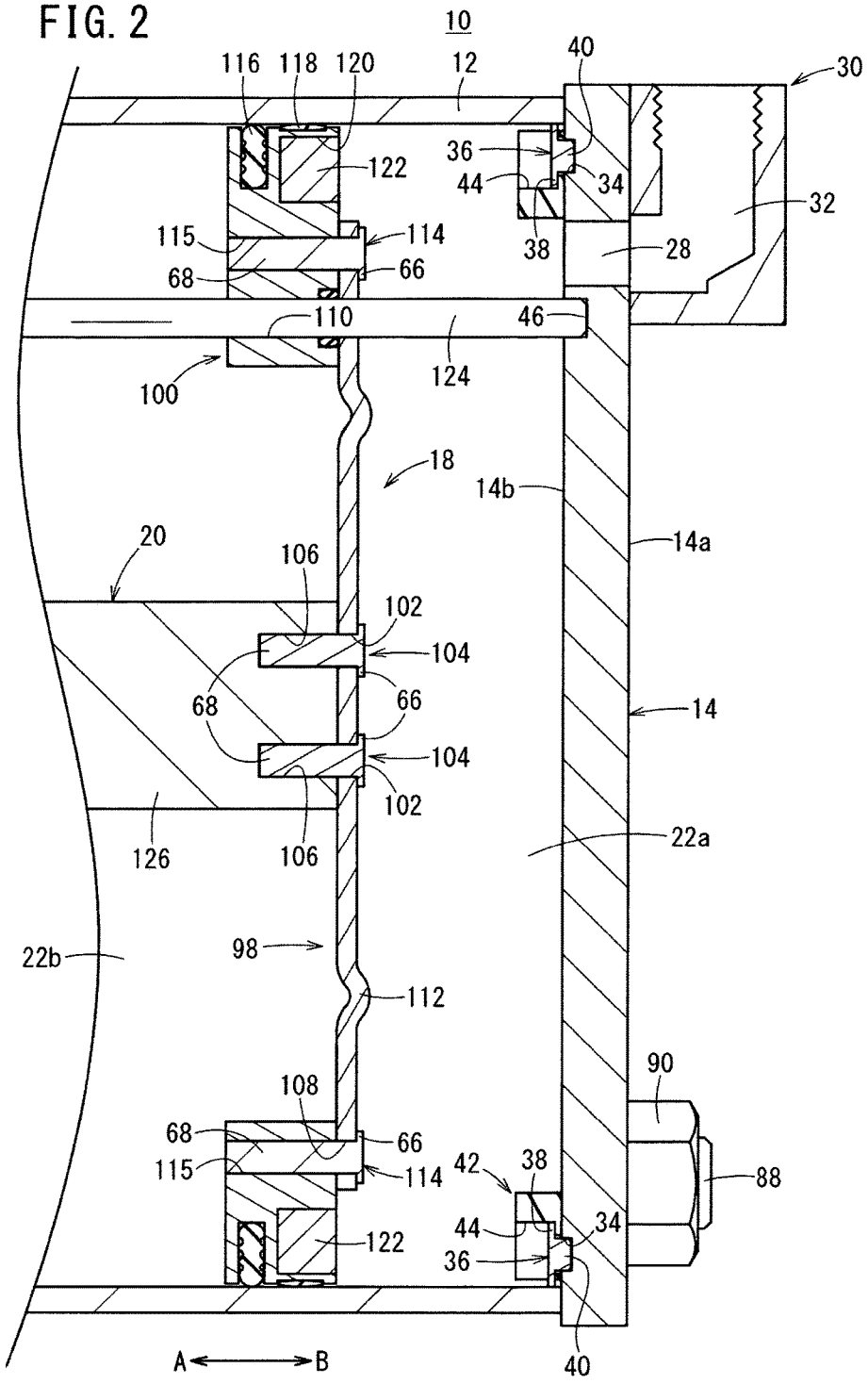
FIG. 2 is an enlarged cross-sectional view of the vicinity of a piston unit in the fluid pressure cylinder of FIG. 1.

On the other hand, on an inner wall surface 14*b* of the head cover 14 formed on a side of the cylinder tube 12 (in the direction of the arrow A), as shown in FIGS. 1, 2, and 4A, a plurality of (for example, three) first pin holes 34 are formed on a circumference that is smaller in diameter than the inner circumferential diameter of the cylinder tube 12, and first spigot pins 36 are inserted respectively into the first pin holes 34. The first pin holes 34 are formed on a circumference having a predetermined diameter with respect to the center of the head cover 14, and are separated by equal intervals mutually along the circumferential direction.

The first spigot pins 36 are disposed in a plurality so as to be of the same number as the first pin holes 34, and are made up from flange members 38 formed with circular shapes in cross section, and shaft members 40 of a smaller diameter than the flange members 38 which are inserted into the first pin holes 34. In addition, by press-fitting of the shaft members 40 of the first spigot pins 36 into the first pin holes 34, the first spigot pins 36 are fixed, respectively, to the inner wall surface 14*b* of the head cover 14, and the flange members 38 thereof are in a state of projecting out with respect to the inner wall surface 14*b* of the head cover 14.

When the cylinder tube 12 is assembled with respect to the head cover 14, as shown in FIG. 4A, the outer circumferential surfaces of the flange members 38 of the first spigot pins 36 come into internal contact with, i.e., inscribe, respectively, the inner circumferential surface of the cylinder tube 12, whereby the cylinder tube 12 is positioned with respect to the head cover 14. More specifically, the plural first spigot pins 36 function as positioning means for positioning the one end of the cylinder tube 12 with respect to the head cover 14.

Stated otherwise, the first spigot pins 36 are arranged on a circumference having a predetermined diameter so that the outer circumferential surfaces thereof internally contact or inscribe the inner circumferential surface of the cylinder tube 12.

A ring shaped first damper 42 is disposed on the inner wall surface 14*b* of the head cover 14. The first damper 42, for example, is formed with a predetermined thickness from a resilient material such as rubber or the like, and the inner circumferential surface thereof is arranged more on a radial outward side than the first communication hole 28 (see FIGS. 2 and 4A).

Further, in the first damper 42, plural cutaway sections 44 are included, which are recessed with substantially circular shapes in cross section radially inward from the outer circumferential surface of the first damper 42, and the first spigot pins 36 are inserted through the cutaway sections 44. More specifically, the cutaway sections 44 are provided in the same number, at the same pitch, and on the same circumference as the first spigot pins 36. In addition, as shown in FIG. 2, by the first damper 42 being sandwiched between the inner wall surface 14*b* of the head cover 14 and the flange members 38 of the first spigot pins 36, the first damper 42 is retained in a state of projecting out at a predetermined height with respect to the inner wall surface 14*b*.

More specifically, at the same time as functioning as positioning means (spigot means) for positioning the one end of the cylinder tube 12 at a predetermined position with respect to the head cover 14, the first spigot pins 36 also function as fixing means for fixing the first damper 42 to the head cover 14.

In addition, when the piston unit 18 is displaced to the side of the head cover 14 (in the direction of the arrow B), by the end thereof coming into abutment against the first damper 42, direct contact between the piston unit 18 and the head cover 14 is avoided, and the occurrence of shocks and impact noises accompanying such contact is suitably prevented.

Further, a first rod hole 46 in which a later-described guide rod 124 is supported is formed in the head cover 14 at a position located further toward the central side with respect to the first communication hole 28. The first rod hole 46 opens toward the side of the inner wall surface 14*b* of the head cover 14 (in the direction of the arrow A) and does not penetrate through to the outer wall surface 14*a*.

As shown in FIGS. 1, 3B, 4B, and 6, the rod cover 16, in the same manner as the head cover 14, for example, is a plate body that is formed with a substantially rectangular shape in cross section from a metal material, which is provided to cover the other end of the cylinder tube 12. At this time, by the seal member (not shown), which is disposed on the end of the cylinder tube 12, abutting against the rod cover 16, the pressure fluid is prevented from leaking out from the cylinder chamber 22*b* through a gap between the cylinder tube 12 and the rod cover 16.

A rod hole 48 is formed to penetrate in an axial direction (the directions of arrows A and B) through the center of the rod cover 16, and four second holes 50 through which the later-described connecting rods 88 are inserted are formed in the four corners of the rod cover 16. Further, a second communication hole 52 is formed in the rod cover 16 at a position located on the central side with respect to the second holes 50. The rod hole 48, the second holes 50, and the second communication hole 52 are formed to penetrate respectively in the thickness direction (the directions of arrows A and B) through the rod cover 16.

Figure 6:
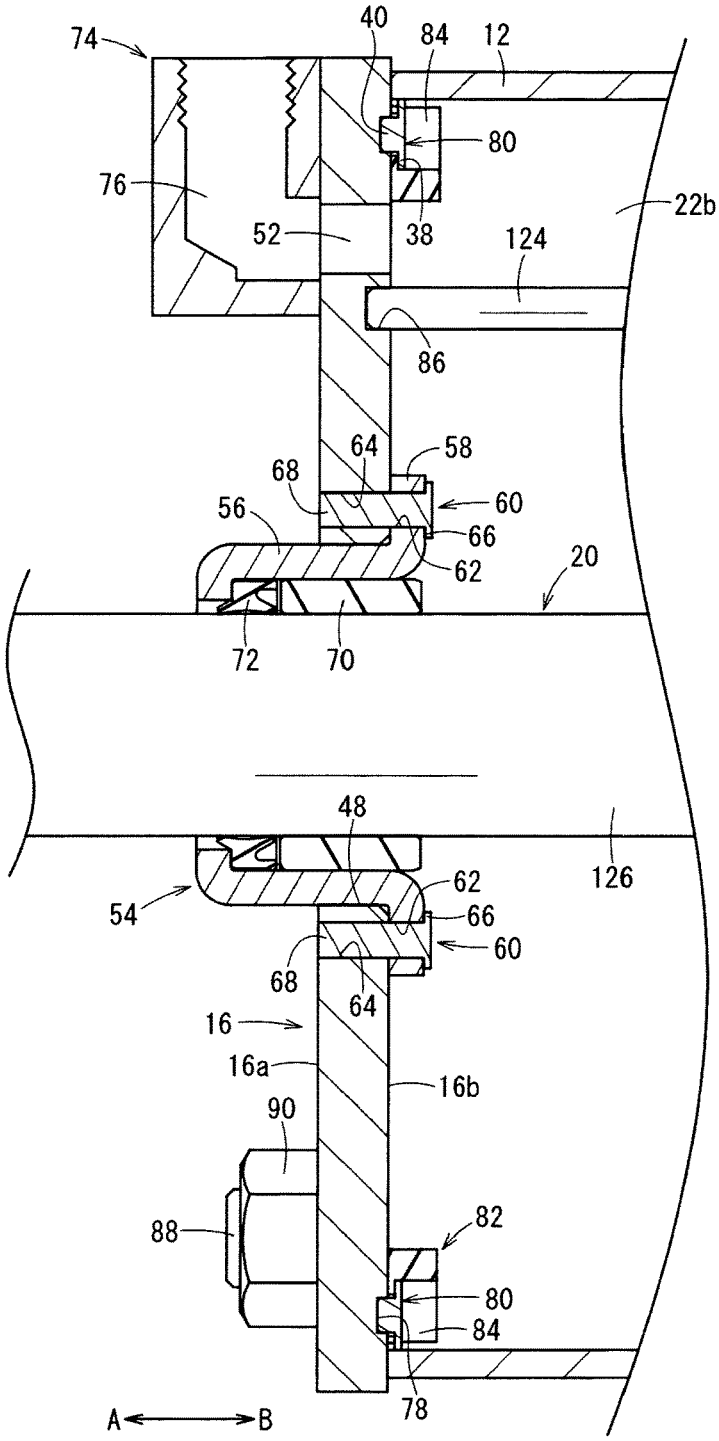
FIG. 6 is an enlarged cross-sectional view showing the vicinity of a rod cover in the fluid pressure cylinder of FIG. 1.

A holder (rod holder) 54 that displaceably supports the piston rod 20 is provided in the rod hole 48. As shown in FIGS. 1 and 6, for example, the holder 54 is formed by a drawing process or the like from a metal material, and includes a cylindrical holder main body 56, and a flange member 58 formed on one end of the holder main body 56 and which is expanded radially outward in diameter. A portion of the holder main body 56 is disposed so as to project outside from the rod cover 16 (see FIG. 1).

In addition, in a state in which the holder main body 56 is inserted through the rod hole 48 of the rod cover 16, and the flange member 58 is arranged on the side of the cylinder tube 12 (in the direction of the arrow B), the flange member 58 abuts against an inner wall surface 16*b* of the rod cover 16, and a plurality of (for example, four) first rivets (rivets) 60 are inserted into and made to engage with first rivet holes 64 of the rod cover 16 via first through holes 62 of the flange member 58. As a result, the holder 54 is fixed with respect to the rod hole 48 of the rod cover 16. At this time, the holder 54 is fixed coaxially with the rod hole 48.

The first rivets 60, for example, are self-drilling or self-piercing rivets each having a circular flange member 66, and a shaft-shaped pin member 68 that is reduced in diameter with respect to the flange member 66. In a state with the first rivets 60 being inserted into the first through holes 62 from the side of the flange member 58, and the flange members 66 thereof engaging with the flange member 58, by punching the pin members 68 into the first rivet holes 64 of the rod cover 16, the pin members 68 are engaged with respect to the first through holes 62, and the flange member 58 is fixed with respect to the rod cover 16.

The first rivets 60 are not limited to being self-drilling rivets, and for example, may be general rivets that are fixed by having the pin members 68 thereof crushed and deformed after having been pushed out to the side of an outer wall surface 16*a* of the rod cover 16.

A bush 70 and a rod packing 72 are disposed alongside one another in the axial direction (the directions of arrows A and B) in the interior of the holder 54, and by the later-described piston rod 20 being inserted through the interior portion thereof, simultaneously with the piston rod 20 being guided along the axial direction by the bush 70, the rod packing 72 slides in contact therewith, whereby leakage of pressure fluid through a gap between the holder 54 and the rod packing 72 is prevented.

Figure 3A:
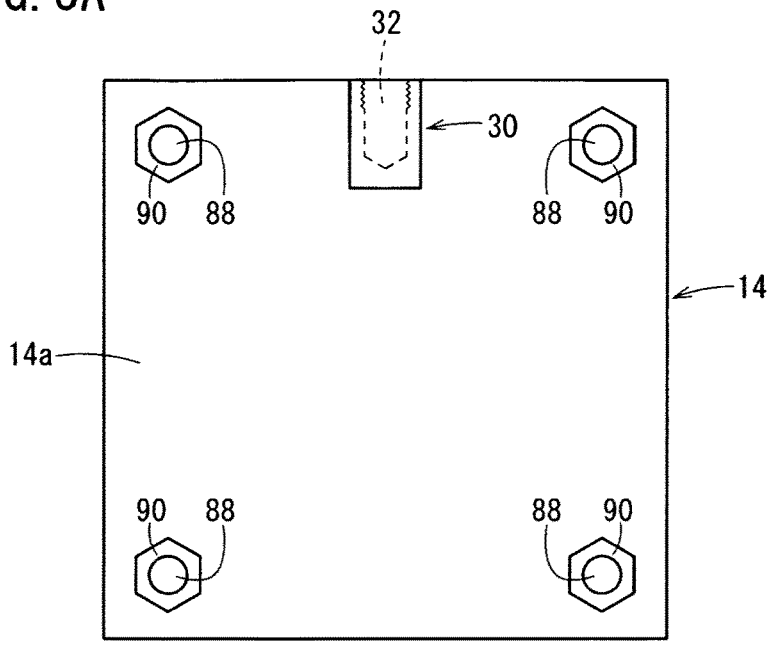
FIG. 3A is a front view as seen from a side of a head cover in the fluid pressure cylinder of FIG. 1.
Figure 3B:
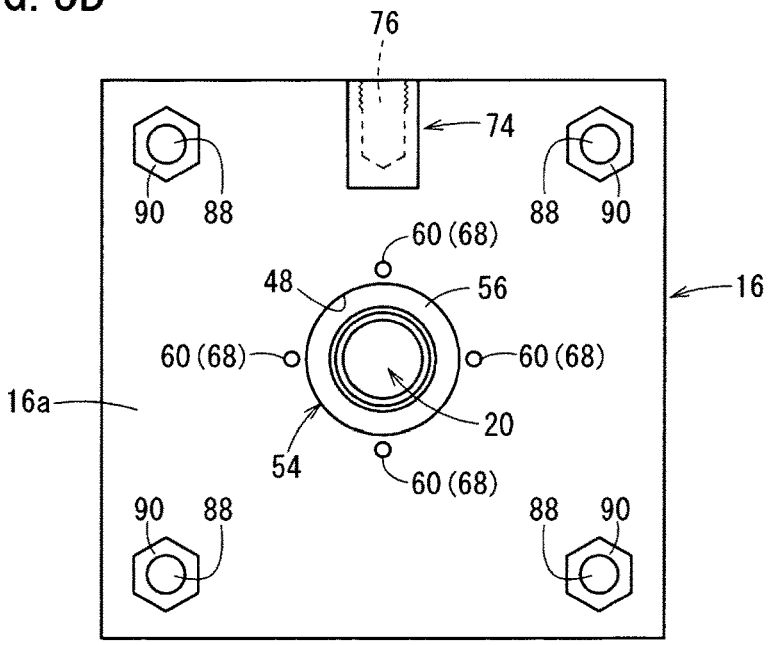
FIG. 3B is a front view as seen from a side of a rod cover in the fluid pressure cylinder of FIG. 1.

As shown in FIGS. 1, 3B, and 6, a second port member 74 from which the pressure fluid is supplied and discharged is provided on the outer wall surface 16*a* of the rod cover 16, to which a pressure fluid supply source is connected through a non-illustrated pipe. The second port member 74, for example, is constituted from a block body, which is formed from a metal material, and is fixed by welding or the like.

Further, in the interior of the second port member 74, a port passage 76, which is formed with an L-shape in cross-section, is formed, and an opening thereof is fixed with respect to the outer wall surface 16*a* of the rod cover 16 in a state of being opened in a direction perpendicular to the axial direction of the cylinder tube 12.

In addition, by the port passage 76 of the second port member 74 communicating with the second communication hole 52 of the rod cover 16, the second port member 74 and the interior of the cylinder tube 12 are placed in communication.

Instead of providing the second port member 74, for example, a pipe connection fitting may be connected directly with respect to the second communication hole 52.

Figure 4B:
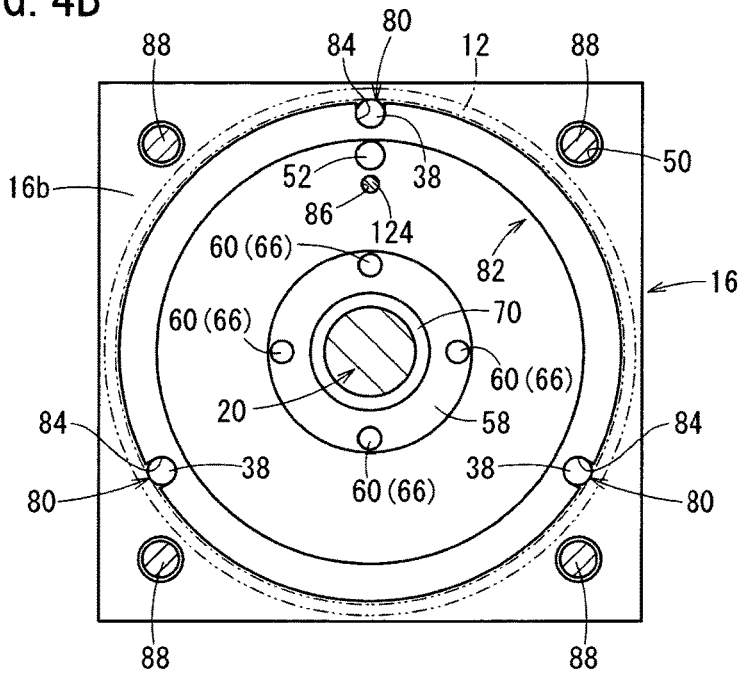
FIG. 4B is a front view shown partially in cross section of the rod cover of FIG. 3B as seen from a side of the cylinder tube.

On the other hand, on the inner wall surface 16*b* of the rod cover 16 that is formed on a side of the cylinder tube 12 (in the direction of the arrow B), as shown in FIGS. 1, 4B, and 6, a plurality of (for example, three) second pin holes 78 are formed on a circumference that is smaller in diameter than the inner circumferential diameter of the cylinder tube 12, and second spigot pins 80 are inserted respectively into the second pin holes 78. More specifically, the second spigot pins 80 are provided in plurality in the same number as the second pin holes 78.

The second pin holes 78 are formed on a circumference having a predetermined diameter with respect to the center of the rod cover 16, and are separated by equal intervals mutually along the circumferential direction. The second spigot pins 80 are formed in the same shape as the first spigot pins 36, and therefore, detailed description thereof is omitted.

In addition, by insertion of the shaft members 40 of the second spigot pins 80 into the second pin holes 78, the second spigot pins 80 are fixed, respectively, to the inner wall surface 16*b* of the rod cover 16, and the flange members 38 thereof are in a state of projecting out with respect to the inner wall surface 16*b* of the rod cover 16.

Further, when the cylinder tube 12 is assembled with respect to the rod cover 16, as shown in FIG. 4B, the outer circumferential surfaces of the flange members 38 of the second spigot pins 80 come into internal contact with, i.e., inscribe, respectively, the inner circumferential surface of the cylinder tube 12, whereby the cylinder tube 12 is positioned with respect to the rod cover 16. More specifically, the plural second spigot pins 80 function as positioning means for positioning the other end of the cylinder tube 12 with respect to the rod cover 16.

Stated otherwise, the second spigot pins 80 are arranged on a circumference having a predetermined diameter so that the outer circumferential surfaces thereof internally contact or inscribe the inner circumferential surface of the cylinder tube 12.

A ring shaped second damper 82 is disposed on the inner wall surface 16*b* of the rod cover 16. The second damper 82, for example, is formed with a predetermined thickness from a resilient material such as rubber or the like, and the inner circumferential surface thereof is arranged more radially outward than the second communication hole 52.

Further, in the second damper 82, plural cutaway sections 84 are included, which are recessed with substantially circular shapes in cross section radially inward from the outer circumferential surface of the second damper 82, and the second spigot pins 80 are inserted through the cutaway sections 84. In addition, by the second damper 82 being sandwiched between the inner wall surface 16*b* of the rod cover 16 and the flange members 38 of the second spigot pins 80, the second damper 82 is retained in a state of projecting out at a predetermined height with respect to the inner wall surface 16*b*.

More specifically, the cutaway sections 84 are provided in the same number, at the same pitch, and on the same circumference as the second spigot pins 80.

In this manner, at the same time as functioning as positioning means (spigot means) for positioning the other end of the cylinder tube 12 at a predetermined position with respect to the rod cover 16, the second spigot pins 80 also function as fixing means for fixing the second damper 82 to the rod cover 16.

In addition, when the piston unit 18 is displaced to the side of the rod cover 16 (in the direction of the arrow A), by the end thereof coming into abutment against the second damper 82, direct contact between the piston unit 18 and the rod cover 16 is avoided, and the occurrence of shocks and impact noises accompanying such contact is suitably prevented.

Further, a second rod hole 86 in which the later-described guide rod 124 is supported is formed at a position located further toward the central side of the rod cover 16 with respect to the second communication hole 52. As shown in FIG. 1, the second rod hole 86 opens toward the side of the inner wall surface 16*b* of the rod cover 16 (in the direction of the arrow B) and does not penetrate through to the outer wall surface 16*a*.

In addition, in a state in which the one end of the cylinder tube 12 is placed in abutment against the inner wall surface 14*b* of the head cover 14 and the other end thereof is placed in abutment against the inner wall surface 16*b* of the rod cover 16, the connecting rods 88 are inserted respectively through the four first and second holes 26, 50, fastening nuts 90 (see FIGS. 1, 3A, and 3B) are screw-engaged on both ends thereof, and the fastening nuts 90 are tightened until they come into abutment against the outer wall surfaces 14*a*, 16*a* of the head cover 14 and the rod cover 16. As a result, the cylinder tube 12 is fixed in a condition of being sandwiched and gripped between the head cover 14 and the rod cover 16.

Figure 5:
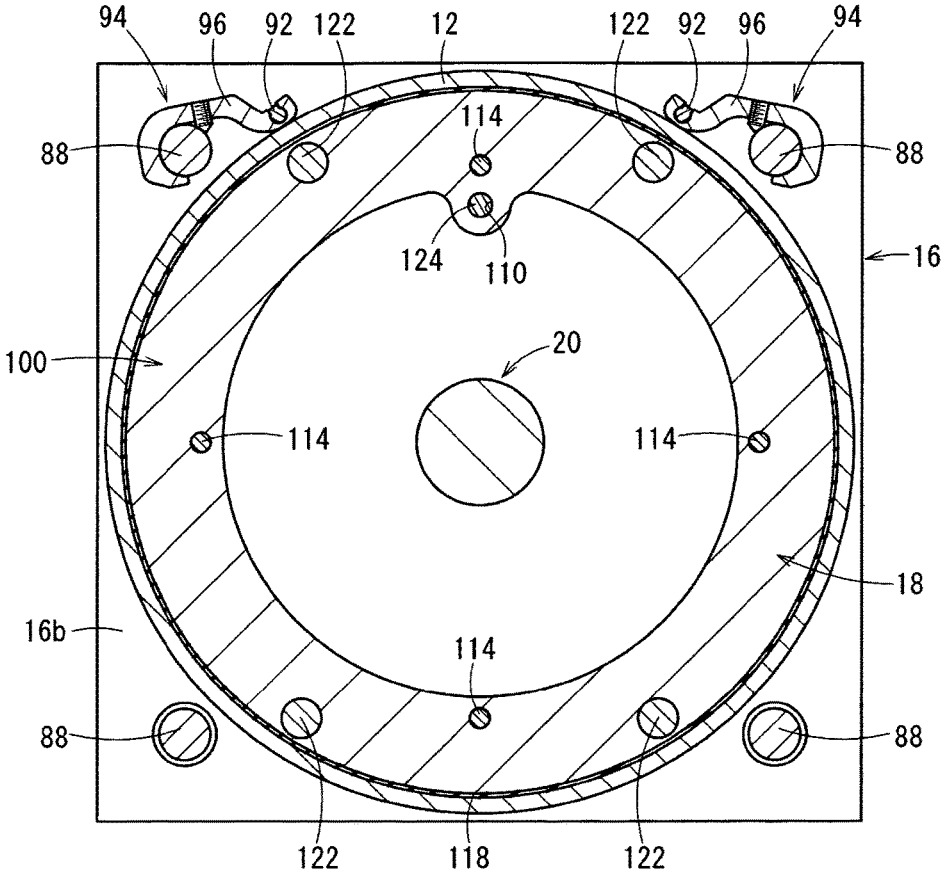
FIG. 5 is a cross-sectional view taken along line V-V of FIG. 1.

Further, as shown in FIG. 5, sensor retaining bodies 94 that hold detecting sensors 92 for detecting the position of the piston unit 18 are disposed on the connecting rods 88. The sensor retaining bodies 94 are disposed substantially perpendicular with respect to the direction of extension of the connecting rods 88, and are disposed so as to be capable of moving along the connecting rods 88, together with including mounting sections 96 that extend from the locations retained on the connecting rods 88 and in which the detecting sensors 92 are mounted. In the mounting sections 96, grooves, which are circular in cross section, for example, are formed substantially in parallel with the connecting rods 88, with the detecting sensors 92 being housed and retained in the grooves.

The detecting sensors 92 are magnetic sensors that are capable of detecting magnetism possessed by magnets 122 of a later-described ring body 100. The sensor retaining bodies 94 including the detection sensors 92 are selectively provided at a quantity as needed.

As shown in FIGS. 1, 2, and 6, the piston unit 18 includes a disk shaped plate body 98, which is connected to one end of the piston rod 20, and the ring body 100 connected to an outer edge portion of the plate body 98.

The plate body 98, for example, is formed with a substantially constant thickness from a metal plate member having elasticity, and a plurality of (for example, four) second through holes 102 that penetrate therethrough in the thickness direction are disposed in a central portion of the plate body 98. In addition, second rivets 104 are inserted into the second through holes 102, and by distal ends thereof being inserted into and engaged with second rivet holes 106 that are formed in the one end of the piston rod 20, the plate body 98 is connected substantially perpendicular to the one end of the piston rod 20.

The second rivets 104, for example, similar to the first rivets 60, are self-drilling rivets. After the second rivets 104 are inserted such that the flange members 66 thereof are placed on the side of the head cover 14 (in the direction of the arrow B) of the plate body 98, by punching the pin members 68 into the interior of the piston rod 20, the pin members 68 are engaged with respect to the second rivet holes 106, and the plate body 98 is fixed in engagement with respect to the piston rod 20.

Further, on an outer edge portion of the plate body 98, a plurality of (for example, four) third through holes 108 are provided that penetrate in the thickness direction. The third through holes 108 are formed at equal intervals mutually along the circumferential direction of the plate body 98, together with being formed on the same diameter with respect to the center of the plate body 98.

Furthermore, on the plate body 98, at a position more on an inner circumferential side than the third through holes 108, a rod insertion hole 110 is formed that penetrates in the thickness direction, and through which the later-described guide rod 124 is inserted.

Further still, on the plate body 98, at a position between the outer edge portion and the center portion that is fixed to the piston rod 20, for example, a rib 112 is included which has a curved shape in cross section. The rib 112 is formed in an annular shape along the circumferential direction, and is formed so as to project out toward an opposite side (in the direction of the arrow B) from the side of the piston rod 20. Further, the rib 112 may be formed to project out toward the side of the piston rod 20 (in the direction of the arrow A). Moreover, the rib 112 is formed at a position more on the inner circumferential side than the rod insertion hole 110.

More specifically, by providing the rib 112, the degree of deflection of the elastic plate body 98 is set to a predetermined amount. Stated otherwise, by appropriately modifying the shape and position of the rib 112, the amount of deflection of the plate body 98 can be freely adjusted. Further, the aforementioned rib 112 need not necessarily be provided.

The plate body 98 is not limited to the case of being connected to the end of the piston rod 20 by the second rivets 104, and for example, the plate body 98 may be connected to the end of the piston rod 20 by caulking or welding, may be connected thereto by press-contact and adhesion, or may be connected by screw-insertion. Furthermore, the plate body 98 may be connected by press-fitting of a pin into the end of the piston rod 20 and plastic deformation of the end of the pin.

The ring body 100, for example, is formed with a circular shape in cross section from a metal material, and the outer edge portion of the plate body 98 is placed in abutment against an edge portion thereof on the side of the head cover 14 (in the direction of the arrow B), and is fixed thereto by a plurality of third rivets 114. The third rivets 114, for example, similar to the first and second rivets 60, 104, are self-drilling rivets. After the third rivets 114 are inserted such that the flange members 66 thereof are placed on the side of the head cover 14 (in the direction of the arrow B) of the plate body 98, by punching the pin members 68 into third rivet holes 115 of the ring body 100, the pin members 68 are engaged and latched in the interior thereof.

Further, as shown in FIG. 2, a piston packing 116 and a wear ring 118 are disposed on the ring body 100 through annular grooves formed on the outer circumferential surface thereof. In addition, by the piston packing 116 sliding in contact with the inner circumferential surface of the cylinder tube 12, leakage of pressure fluid through a gap between the ring body 100 and the cylinder tube 12 is prevented. Further, by the wear ring 118 sliding in contact with the inner circumferential surface of the cylinder tube 12, the ring body 100 is guided in the axial direction (the directions of arrows A and B) along the cylinder tube 12.

Furthermore, as shown in FIGS. 1 and 2, on a side surface of the ring body 100 facing toward the head cover 14, a plurality of (for example, four) holes 120, which are opened in the axial direction, are formed, and cylindrical magnets 122 are press-fitted, respectively, into the interiors of the holes 120. The arrangement of the magnets 122 is such that, when the piston unit 18 is disposed in the interior of the cylinder tube 12, as shown in FIG. 5, the magnets 122 are disposed at positions facing toward the four connecting rods 88, and the magnetism of the magnets 122 is detected by the detecting sensors 92 of the sensor retaining bodies 94 that are provided on the connecting rods 88.

As shown in FIGS. 1, 2, and 4A through 6, the guide rod 124 is formed as a shaft with a circular shape in cross section, with one end thereof being inserted into the first rod hole 46 of the head cover 14, and the other end thereof being inserted into the second rod hole 86 of the rod cover 16, together with being inserted through the rod insertion hole 110 of the plate body 98. Owing thereto, in the interior of the cylinder tube 12, the guide rod 124 is fixed to the head cover 14 and the rod cover 16, and is disposed in parallel with the axial direction (displacement direction) of the piston unit 18, together with the piston unit 18 being prevented from undergoing rotation when the piston unit 18 is displaced in the axial direction. Stated otherwise, the guide rod 124 functions as a rotation stop for the piston unit 18.

Further, an O-ring is disposed in the rod insertion hole 110, whereby leakage of pressure fluid through a gap between the guide rod 124 and the rod insertion hole 110 is prevented.

As shown in FIG. 1, the piston rod 20 is made up from a shaft having a predetermined length along the axial direction (the directions of arrows A and B), and includes a main body portion 126 formed with a substantially constant diameter, and a small diameter distal end portion 128 formed on the other end of the main body portion 126. The distal end portion 128 is disposed so as to be exposed to the outside of the cylinder tube 12 through the holder 54. The one end of the main body portion 126 is formed in a substantially planar surface shape perpendicular to the axial direction of the piston rod 20, and is connected to the plate body 98.

The fluid pressure cylinder 10 according to the embodiment of the present invention is constructed basically as described above. Next, operations and advantageous effects of the fluid pressure cylinder 10 will be described. A condition in which the piston unit 18 is displaced to the side of the head cover 14 (in the direction of the arrow B) will be described as an initial position.

At first, a pressure fluid is introduced to the first port member 30 from a non-illustrated pressure fluid supply source. In this case, the second port member 74 is placed in a state of being open to atmosphere under a switching operation of a non-illustrated switching valve. Consequently, the pressure fluid is supplied from the first port member 30 to the port passage 32 and the first communication hole 28, and by the pressure fluid that is introduced into the cylinder chamber 22*a* from the first communication hole 28, the piston unit 18 is pressed toward the side of the rod cover 16 (in the direction of the arrow A).

In addition, the piston rod 20 is displaced while being guided in the holder 54 together with the piston unit 18, and by the end surface of the ring body 100 coming into abutment against the second damper 82, a displacement terminal end position is reached.

On the other hand, in the case that the piston unit 18 is to be displaced in the opposite direction (in the direction of the arrow B), together with the pressure fluid being supplied to the second port member 74, the first port member 30 is placed in a state of being open to atmosphere under a switching operation of the switching valve (not shown). In addition, the pressure fluid is supplied from the second port member 74, through the port passage 76 and the second communication hole 52, to the cylinder chamber 22*b*, and by the pressure fluid that is introduced into the cylinder chamber 22*b*, the piston unit 18 is pressed toward the side of the head cover 14 (in the direction of the arrow B).

The piston rod 20 is displaced while being guided in the holder 54 under the displacement action of the piston unit 18, and the initial position is restored by the ring body 100 of the piston unit 18 coming into abutment against the first damper 42 of the head cover 14.

Further, when the piston unit 18 is displaced along the cylinder tube 12 in the axial direction (the directions of arrows A and B) in the manner described above, by being displaced along the guide rod 124 that is inserted through the interior of the piston unit 18, rotational displacement thereof does not take place, the magnets 122 provided in the piston unit 18 are positioned in facing relation to the detection sensors 92, and the displacement of the piston unit 18 can reliably be detected by the detection sensors 92.

In the foregoing manner, according to the present embodiment, a configuration is provided in which, in the fluid pressure cylinder 10, the holder 54 is provided, which is disposed in the rod cover 16 and displaceably retains the piston rod 20, and the flange member 58 of the holder 54, which is formed from a plate-like material, is fixed by the first rivets 60 in a state in which the flange member 58 abuts against the inner wall surface 16*b* of the rod cover 16. Therefore, compared to a conventional fluid pressure cylinder in which the rod cover is formed with a predetermined thickness, and a rod hole is provided in the interior thereof which is capable of supporting the piston rod, a thickness in the axial direction (the directions of arrows A and B) of the rod cover 16 can be formed thinly, and along therewith, the length of the fluid pressure cylinder 10 in the axial direction (the directions of arrows A and B) can be reduced in size.

Further, since the flange members 66 of the first rivets 60 are thinner than the head portions of general screws or the like, on the rod cover 16, it is possible to reduce the amount by which the flange members 66 project out toward the side of the piston unit 18 (in the direction of the arrow B), and when the piston unit 18 is displaced toward the side of the rod cover 16 (in the direction of the arrow A), a large stroke amount can be assured.

Stated otherwise, when a fluid pressure cylinder is constructed having the same stroke length, since the rod cover 16 can be arranged in closer proximity to the side of the cylinder tube 12 (in the direction of the arrow B), the total length of the fluid pressure cylinder 10 can be reduced.

Further, compared to the case of fastening the rod cover 16 and the flange member 58 of the holder 54, both of which are of plate-like shapes respectively, using screws or the like, fastening them by the first rivets 60 can more easily be performed.

Further still, by using self-drilling rivets as the first rivets 60, since fastening can be concluded easily merely by punching the first rivets 60 toward the side of the rod cover 16 from the side of the flange member 58 of the holder 54 (in the direction of the arrow A), for example, compared to the case of fastening by bolts or the like, the number of assembly steps can be reduced.

Still further, since a configuration is provided which is capable of retaining the bush 70 and the rod packing 72 at the interior of the holder 54, compared to the conventional fluid pressure cylinder in which groove machining is performed for installation of the bush or the like in the rod hole, the number of manufacturing steps and manufacturing costs can be reduced.

Further, the holder 54 for displaceably supporting the piston rod 20 is not limited to the structure described above. For example, as with a holder 130 shown in FIG. 7A, the holder 130 may be constituted from a first holder section 132 that retains the bush 70, and a second holder section 134 that retains the rod packing 72.

Figures 7A, 7B, 7C:
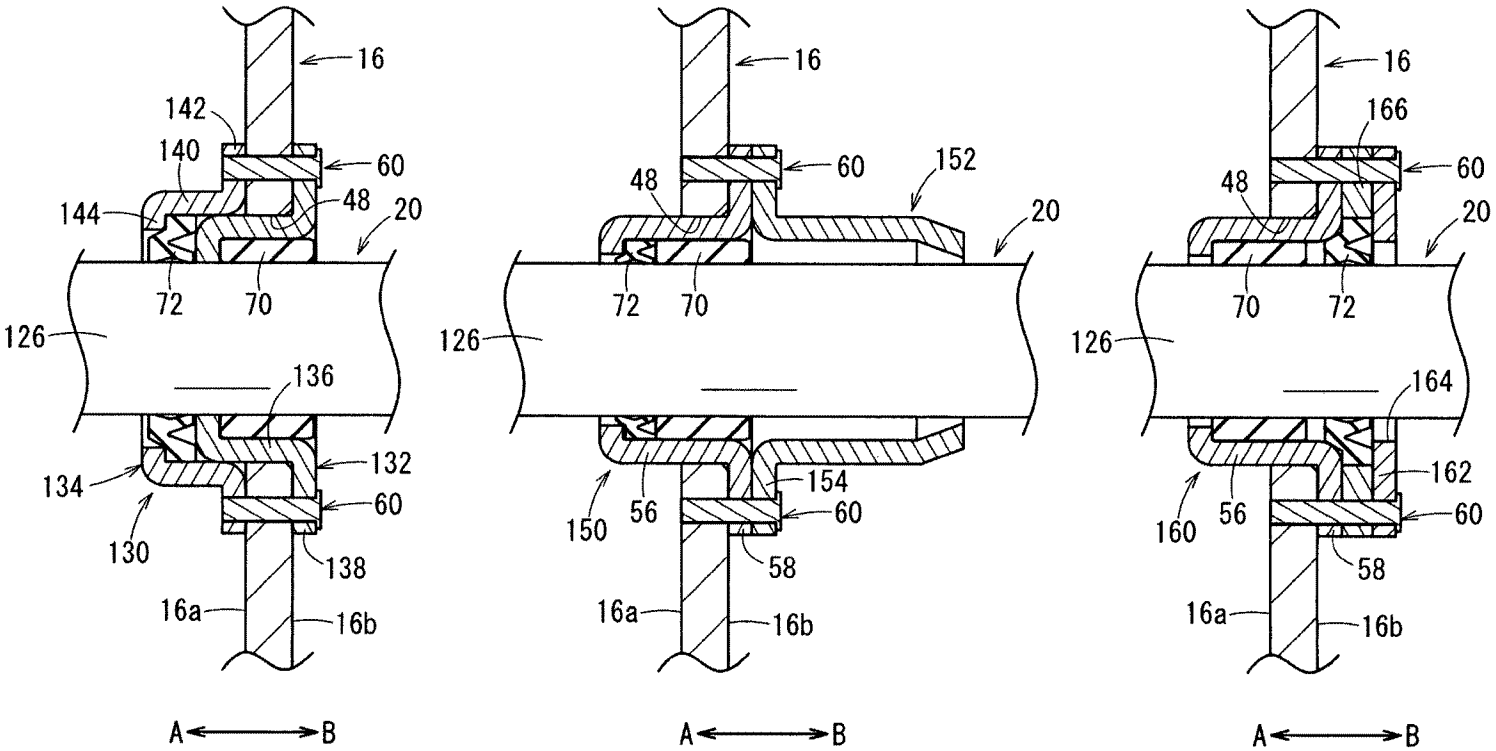
FIG. 7A is an enlarged cross-sectional view showing the vicinity of a rod cover to which a holder according to a first modification is applied.
FIG. 7B is an enlarged cross-sectional view showing the vicinity of a rod cover to which a holder according to a second modification is applied.
FIG. 7C is an enlarged cross-sectional view showing the vicinity of a rod cover to which a holder according to a third modification is applied.

As shown in FIG. 7A, the first holder section 132 includes a first holder main body 136, which is formed in a cylindrical shape by a drawing process or the like from a metal material, and a first flange member 138 formed on one end of the first holder main body 136 and which is expanded radially outward in diameter. On the other hand, in the same manner as the first holder section 132, the second holder section 134 includes a second holder main body 140, which is formed in a cylindrical shape by a drawing process or the like from a metal material, and a second flange member 142 formed on one end of the second holder main body 140 and which is expanded radially outward in diameter.

The first flange member 138 of the first holder section 132 is disposed so as to abut against the inner wall surface 16*b* of the rod cover 16, and the bush 70 is disposed in the interior of the first holder main body 136.

On the other hand, concerning the second holder section 134, the second flange member 142 thereof is disposed so as to abut against the outer wall surface 16*a* of the rod cover 16, and a portion of the first holder main body 136 is inserted in the interior of the second holder main body 140, together with the rod packing 72 being disposed therein. The rod packing 72 is engaged with a stepped portion 144 formed on an end of the second holder main body 140, and the rod packing 72 is retained in the axial direction (the directions of arrows A and B) as a result of being sandwiched between the stepped portion 144 and the end of the first holder main body 136.

More specifically, the first holder main body 136 is formed with a smaller diameter than that of the second holder main body 140.

In addition, in a state in which the first flange member 138 of the first holder section 132, the rod cover 16, and the second flange member 142 of the second holder section 134 are placed in mutual abutment, and by punching a plurality of first rivets 60 in the axial direction (the direction of the arrow A) from the side of the cylinder tube 12, such members are fixed together integrally with the first flange member 138, the rod cover 16, and the second flange member 142 in a stacked condition. As a result, the holder 130, which is made up from the first and second holder sections 132, 134, is fixed with respect to the rod hole 48 of the rod cover 16, and the piston rod 20 is supported displaceably in the interior thereof.

In this manner, the holder 130, which is made up from the two members of the first holder section 132 and the second holder section 134, can be fixed easily and reliably with respect to the rod cover 16 solely by the first rivets 60. As a result, compared to the case of fastening each of the first holder section 132 and the second holder section 134 separately with respect to the rod cover 16 by bolts or the like, assembly thereof can be facilitated, and it is possible to reduce the number of component parts. Stated otherwise, it is possible for the first flange member 138 and the second flange member 142, which are stacked with respect to the rod cover 16, to be fastened and fixed easily and reliably by the first rivets 60.

Further, because a structure is provided in which the rod packing 72 is gripped and retained between the first holder section 132 and the second holder section 134, there is no need to perform groove machining for mounting of the rod packing 72 with respect to the rod cover 16, and the number of manufacturing steps for the fluid pressure cylinder 10 as well as manufacturing costs therefor can be reduced.

Furthermore, because the first holder section 132 and the second holder section 134 are assembled from opposite sides, respectively, sandwiching the rod cover 16 therebetween, the first and second flange members 138, 142 are prevented respectively from becoming detached from the rod cover 16, and falling off of the first and second holder sections 132, 134 from the rod cover 16 is prevented.

Further still, when another apparatus or the like is assembled from the side of the rod cover 16 with respect to the fluid pressure cylinder 10, the second holder main body 140 of the second holder section 134, which projects outwardly from the rod cover 16, can easily be positioned coaxially by being used as a spigot connection.

Further, a holder 150 shown in FIG. 7B is used in the fluid pressure cylinder 10 in which a cushion mechanism is included, wherein a cushion member 152 that constitutes the cushion mechanism is fixed integrally with respect to the flange member 58. The cushion member 152 is formed, for example, in a cylindrical shape, with an annular mounting flange 154, which extends radially outward from an outer circumferential surface thereof, being formed on one end of the cushion member 152, and the other end thereof being open.

In addition, a condition is established in which the mounting flange 154 of the cushion member 152 is placed in abutment against the flange member 58 of the holder 150, and by punching a plurality of first rivets 60 in the axial direction (the direction of the arrow A) from the side of the cylinder tube 12, the members are fixed together integrally with the mounting flange 154, the flange member 58, and the rod cover 16 in a stacked condition. As a result, at the same time that the holder 150 is fixed with respect to the rod hole 48 of the rod cover 16, the cushion member 152 is fixed in a state of projecting in a direction away from the rod cover 16 (in the direction of the arrow B).

Moreover, by the non-illustrated piston unit 18 being displaced toward the side of the rod cover 16, and the cushion member 152 gradually being inserted in a recess (not shown) that is formed on the piston unit 18, the flow rate of the pressure fluid that is discharged from the second port member 74 is throttled by non-illustrated adjustment valve, accompanied by a cushioning function being conducted to gradually decrease the displacement speed of the piston unit 18 as it approaches the displacement terminal end position.

In the foregoing manner, when the flange member 58 of the holder 150 is fixed to the inner wall surface 16*b* of the rod cover 16 by the first rivets 60, the flange member 58 is fastened together with the mounting flange 154 of the cushion member 152, whereby the cushion member 152 can be easily added. Therefore, the fluid pressure cylinder 10 that includes such a cushion mechanism can be adopted. Further, the cushion member 152 can appropriately be selected and mounted responsive to the desired characteristics of the cushion mechanism.

Further, because the cushion member 152 can be fixed using the first rivets 60 that serve to connect the holder 150 and the rod cover 16, without increasing the quantity of rivets, an increase in the number of parts can be suppressed, together with enabling a reduction in the number of assembly steps.

Furthermore, compared to the case of fixing the cushion member 152 to the rod cover 16 using bolts or the like, by fixing the same using the first rivets 60, the assembly operation can be facilitated, while in addition, the amount by which the cushion member 152 projects out toward the side of the cylinder tube 12 can be reduced. Stated otherwise, it is possible for the flange member 58 and the mounting flange 154, which are stacked with respect to the rod cover 16, to be fastened and fixed easily and reliably by the first rivets 60.

Furthermore, in a holder 160 shown in FIG. 7C, a retaining plate 162 for retaining the rod packing 72 is disposed on the side of the cylinder tube 12. As shown in FIG. 7C, the retaining plate 162 is of a disk shape, which is formed with substantially the same diameter as the flange member 58 of the holder 160, and in the center thereof, a hole 164 is formed through which the piston rod 20 can be inserted. Further, a disk-shaped spacer 166 is disposed between the retaining plate 162 and the holder 160, and the rod packing 72 is disposed on an inner circumferential side of the spacer 166. Moreover, the outside diameter of the spacer 166 also is formed with substantially the same diameter as the flange member 58 and the retaining plate 162.

In addition, a condition is established in which the flange member 58 of the holder 160 is placed in abutment against the inner wall surface 16*b* of the rod cover 16, and by stacking the spacer 166 and the retaining plate 162 in this order, and punching a plurality of first rivets 60 in the axial direction (the direction of the arrow A) from the side of the cylinder tube 12, the members are fixed together integrally with the retaining plate 162, the spacer 166, and the flange member 58 in a stacked condition.

Consequently, at the same time that the holder 160 is fixed with respect to the rod cover 16, the rod packing 72 is gripped and retained by the flange member 58 of the holder 160, the spacer 166, and the retaining plate 162. At this time, the rod packing 72 is held in a condition in which displacement thereof in the axial direction (the directions of arrows A and B) is restricted by the holder 160 and the retaining plate 162.

In this manner, when the retaining plate 162, which is capable of retaining the rod cover 16, and the spacer 166 are disposed on the end of the holder 160, by punching the first rivets 60 in the axial direction, such members can be fixed easily and reliably with respect to the rod cover 16. As a result, compared to the case of fastening each of the retaining plate 162, the spacer 166, and the holder 160 separately with respect to the rod cover 16 by respective bolts or the like, assembly thereof can be facilitated, and it is possible to reduce the number of component parts. Stated otherwise, it is possible for the flange member 58, the spacer 166, and the retaining plate 162, which are stacked with respect to the rod cover 16, to be fastened and fixed easily and reliably by the first rivets 60.

Further, since there is no need to perform groove machining of a rod hole for disposing the rod packing 72 therein, compared to the conventional fluid pressure cylinder, the number of manufacturing steps and manufacturing costs for the fluid pressure cylinder 10 can be reduced.

Figure 8A:
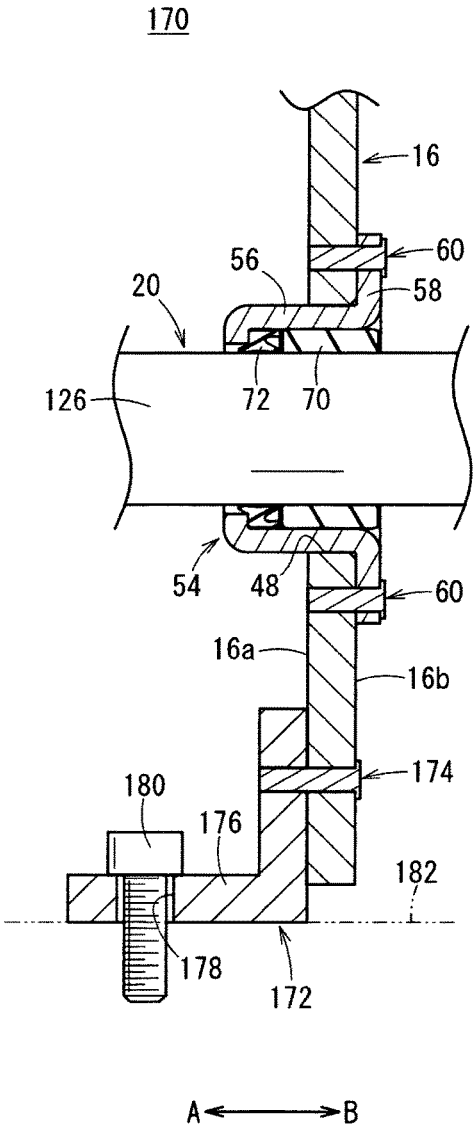
FIG. 8A is an enlarged cross-sectional view showing a case in which a fixing bracket is attached to the rod cover, in the fluid pressure cylinder of FIG. 1.

Furthermore, in the above-described fluid pressure cylinder 10, for example, a fixing bracket is provided for fixing the fluid pressure cylinder 10 to another device or an equipment surface on an assembly line or the like. For example, with a fluid pressure cylinder 170 shown in FIG. 8A, a fixing bracket 172, which is formed with an L-shape in cross section, is included, and is fixed to the rod cover 16 by fourth rivets 174 in a state of abutment with respect to the outer wall surface 16*a* of the rod cover 16. In this case, the flange members 66 of the fourth rivets 174 are arranged on the side of the inner wall surface 16*b* of the rod cover 16, and the fourth rivets 174 are punched from the side of the rod cover 16 toward the side of the fixing bracket 172 (in the direction of the arrow A).

Additionally, a fixing bolt 180 is inserted through a bolt hole 178 that is formed in a bottom wall portion 176 of the fixing bracket 172, which is substantially parallel to the axis of the fluid pressure cylinder 170, and the fluid pressure cylinder 170 is fixed in place, for example, by the fixing bolt 180 being screw-engaged with respect to an installation surface 182.

Figure 8B:
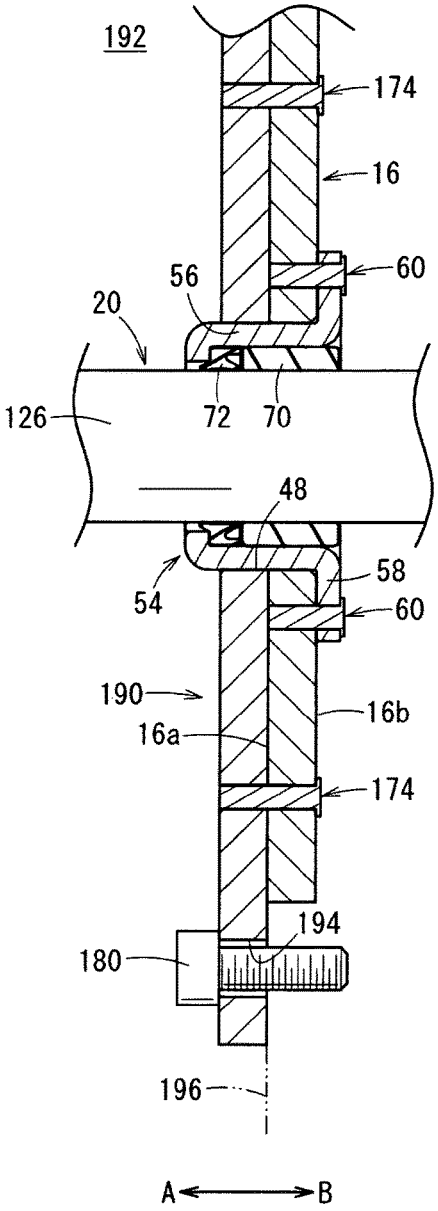
FIG. 8B is an enlarged cross-sectional view showing a case in which another fixing bracket is attached with respect to the rod cover of FIG. 8A.

Further, in place of the aforementioned fixing bracket 172, which is L-shaped in cross section, as shown in FIG. 8B, a plate-shaped fixing bracket 190 may be fixed with respect to the outer wall surface 16*a* of the rod cover 16 by a plurality of the fourth rivets 174. A bolt hole 194 that extends along the axial direction (the directions of arrows A and B) of a fluid pressure cylinder 192 is included in the fixing bracket 190, and the fluid pressure cylinder 192 is fixed in place by the fixing bolt 180, which is inserted through the bolt hole 194, being screw-engaged with an installation surface 196 that is perpendicular to the aforementioned axis.

In the above description, although a case has been described in which the fixing brackets 172, 190 are fixed with respect to the rod cover 16, in a similar manner, the fixing brackets 172, 190 may be fixed with respect to the outer wall surface 14*a* of the head cover 14.

In this manner, when the fixing brackets 172, 190 are fixed with respect to the rod covers 16 of the fluid pressure cylinders 170, 192, the rod covers 16 and the fixing brackets 172, 190 are stacked, and by punching the fourth rivets 174 therein, the fixing brackets 172, 190 can easily and reliably be fixed thereto.

Further, with the conventional fluid pressure cylinder, the fixing brackets 172, 190 are fastened together with respect to the rod cover 16 (or the head cover 14) using connecting rods 88. However, with the present embodiment, the fixing brackets 172, 190 are fixed by the fourth rivets 174 without using the connecting rods 88. Therefore, it is possible for an attachment operation or an exchange operation of the fixing brackets 172, 190 to be performed, without first releasing the fastened state of the connecting rods 88 by which the head cover 14 and the rod cover 16 are fixed to the cylinder tube 12.

The fluid pressure cylinder according to the present invention is not limited to the above embodiment. It is a matter of course that various changes and modifications may be made to the embodiment without departing from the scope of the invention as set forth in the appended claims.

The invention claimed is:

1. A fluid pressure cylinder comprising:

a cylinder tube including a cylinder chamber defined in interior thereof;

a cover member attached to an end of the cylinder tube:

a piston disposed displaceably along the cylinder chamber;

a piston rod connected to the piston;

a rod holder, which supports the piston rod displaceably along an axial direction, disposed in the cover member, and the rod holder is fixed by rivets with respect to the cover member, wherein the rod holder comprises a tubular shaped main body portion configured to support the piston rod and a flange member expanded radially outward with respect to the main body portion, and wherein the flange member is connected in the axial direction by the rivets in a state in which the flange member abuts against a side: surface of the cover member; and a cushion member, which projects out in a direction away from the cover member, disposed on the flange member, the cushion member being fixed by the rivets with respect to the flange member, and by the cushion member being accommodated in an accommodating hole of the piston, a displacement speed of the piston is decelerated.

2. The fluid pressure cylinder according to claim 1, wherein, an interior of the rod holder includes:

a bush configured to support the piston rod displaceably; and a packing configured to prevent leakage of pressure fluid through a gap between the piston rod and the rod holder.

3. The fluid pressure cylinder according to claim 1, wherein the holder comprises:

a first holder section mounted from one end surface side of the cover member; and a second holder section mounted from another end surface side of the cover member.

4. The fluid pressure cylinder according to claim 1, wherein the rivets are self-drilling rivets.

5. A fluid pressure cylinder comprising:

a cylinder tube including a cylinder chamber defined in interior thereof;

a cover member attached to an end of the cylinder tube;

a piston disposed displaceably along the cylinder chamber;

a piston rod connected to the piston; and a rod holder, which supports the piston rod displaceably along an axial direction, disposed in the cover member, and the rod holder is fixed by rivets with respect the cover member, wherein the rod holder comprises a tubular shaped main body portion configured to support the piston rod and a flange member expanded radially outward with respect to the main body portion, wherein the flange member is connected in the axial direction by the rivets in a state in which the flange member abuts against a side surface of the cover member, and wherein a retaining plate is fixed by the rivets through a spacer together with the flange member.

6. The fluid pressure cylinder according to claim 5, wherein, an interior of the rod holder includes:

a bush configured to support the piston rod displaceably; and a packing configured to prevent leakage of pressure fluid through a gap between the piston rod and the rod holder.

7. The fluid pressure cylinder according to claim 5, wherein the holder comprises:

a first holder section mounted from one end surface side of the cover member; and a second holder section mounted from another end surface side of the cover member.

8. The fluid pressure cylinder according to claim 5, wherein the rivets are self-drilling rivets.

* * * * *